United States Patent [19]

Carter, Sr. et al.

[11] 4,023,537

[45] May 17, 1977

[54] TEMPERATURE CONTROL APPARATUS FOR A MONOTUBE BOILER

[76] Inventors: J. Warne Carter, Sr., 4520 Weeks Park Lane, Wichita Falls, Tex. 76308; J. Warne Carter, Jr., P.O. Box 684, Burkburnett, Tex. 76354

[22] Filed: Apr. 13, 1976

[21] Appl. No.: 676,518

[52] U.S. Cl. ..... 122/479 S; 122/448 S; 122/451 S

[51] Int. Cl.[2] ..... F22G 5/00; F22B 29/06

[58] Field of Search ..... 122/448 R, 448 S, 451 R, 122/451 S, 479 S

[56] References Cited

UNITED STATES PATENTS

| | | | |
|---|---|---|---|
| 1,910,843 | 5/1933 | Lieberherr | 122/451 S |
| 1,975,095 | 10/1934 | Fletcher | 122/448 S |
| 2,027,443 | 1/1936 | Lieberherr | 122/448 S |
| 3,111,936 | 11/1963 | Brunner | 122/479 S |
| 3,196,844 | 7/1965 | Sulzer | 122/448 R |

*Primary Examiner*—Kenneth W. Sprague

*Attorney, Agent, or Firm*—Shapiro and Shapiro

[57] ABSTRACT

The temperature of a monotube boiler is controlled by apparatus that regulates the water flow only. Primary water is supplied to the inlet end of the boiler tube in accordance with the heat furnished to the boiler, and secondary water is injected into the boiler tube at a plurality of points spaced along the tube in accordance with the temperature of the steam as determined by a sensor located just upstream of the outlet end of the tube. One of the injection points, termed the feedback point, is located adjacent to and upstream from the temperature sensor. Feedback water injected at the feedback point has an immediate effect on the temperature sensor which is effective to maintain the steam at a substantially constant output temperature during steady state operation over a wide range in the heat furnished to the boiler, and during transient operation from one state to another caused by rapid and large changes in the heat furnished to the boiler.

16 Claims, 12 Drawing Figures

FIG. 1
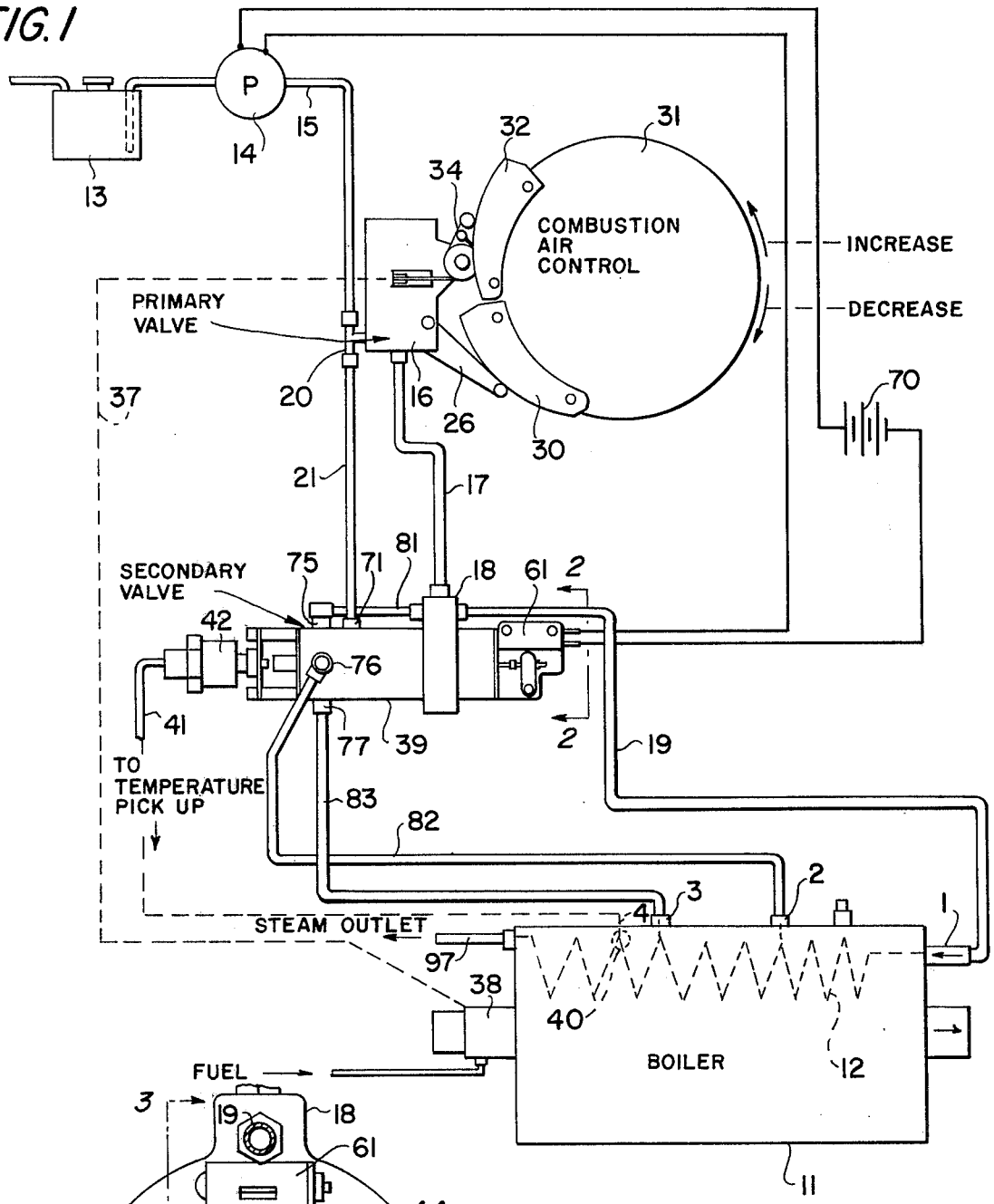
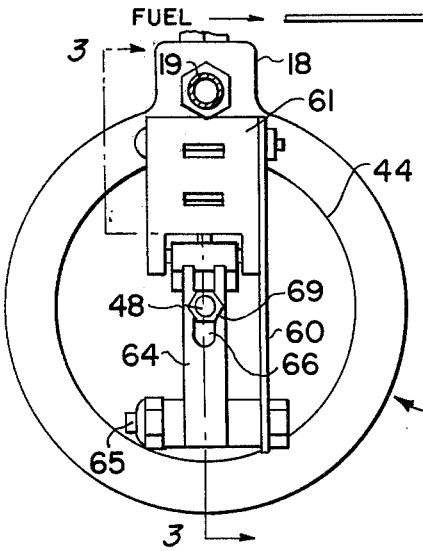
FIG. 2

TEMPERATURE CONTROL APPARATUS FOR A MONOTUBE BOILER

This invention relates to a steam temperature control apparatus for a monotube steam generating boiler, and more particularly to apparatus that controls the steam temperature by regulating the water supply.

BACKGROUND OF THE INVENTION

A boiler employed in the power plant of a vehicle, such as an automobile, must quickly respond to throttle settings that change rapidly and over a wide range. For example, the rate of heat input may change from 50,000 BTU's per hour to one million BTU's per hour in a period of time in the order of magnitude of three seconds. It is therefore of the highest importance to provide sufficient water to the boiler so that the desired final temperature is maintained in the face of the rapidly changing heat input and to prevent any part of the boiler from becoming too hot or too cold during transition from one steady state condition to another. Because of its simplicity, a monotube boiler is ideally suited for automotive use. A typical boiler of this type may contain approximately one quart of water at any time so that when the throttle setting is changed rapidly, as during acceleration, and the heat input increases rapidly, sufficient water must be furnished to the boiler so that the boiler tube temperatures do not become excessive. Furthermore, it is necessary to add water in such precise amounts that overcontrolling and hunting about the new set point do not occur.

It is the function of a temperature control apparatus associated with a monotube boiler of this type to provide the requisite degree of control. An object of the invention, therefore, is to provide a new and improved temperature control apparatus which achieves this result and at the same time utilizes relatively simple components, is very sensitive to changes in temperature in the boiler tube, and acts rapidly in response to such changes to provide the necessary temperature control.

SUMMARY OF THE INVENTION

The temperature control apparatus according to the present invention achieves its control by regulating the water flow only. Primary water is supplied to the inlet end of the boiler tube in accordance with the heat furnished to the boiler, and secondary water is injected into the boiler tube at a plurality of points spaced along the tube in accordance with the temperature of the steam as determined by a sensor located immediately upstream of the outlet end of the tube. One of the injection points is located adjacent to and upsteam from the temperature sensor in a region where the steam is superheated, and is termed the feedback point because water injected at this point (termed the feedback water) has an immediate effect on the temperature sensor which is effective to maintain the steam at a substantially constant output temperature during steady state operation over a wide range in the heat furnished to the boiler, and during transient operation from one state to another caused by rapid and large changes in the heat furnished to the boiler. A pump supplies primary and secondary water to the tube through respective primary and secondary valves, the pump being operated to maintain a predetermined pressure differential across the valves to insure entry of water into the tube. A bypass may be provided to prevent excessive pressure build-up in the event the pressure differential increases beyond said predetermined value.

BRIEF DESCRIPTION OF THE DRAWINGS

An embodiment of the present invention is shown in the accompanying drawings, wherein:

FIG. 1 is a schematic diagram of an improved temperature control system for a monotube boiler constructed in accordance with the present invention;

FIG. 2 is an enlarged cross-sectional view taken substantially on line 2—2 of FIG. 1 and showing the secondary valve assembly of the system in end elevational view;

DESCRIPTION OF THE PREFERRED EMBODIMENTS

Figures 3, 4:
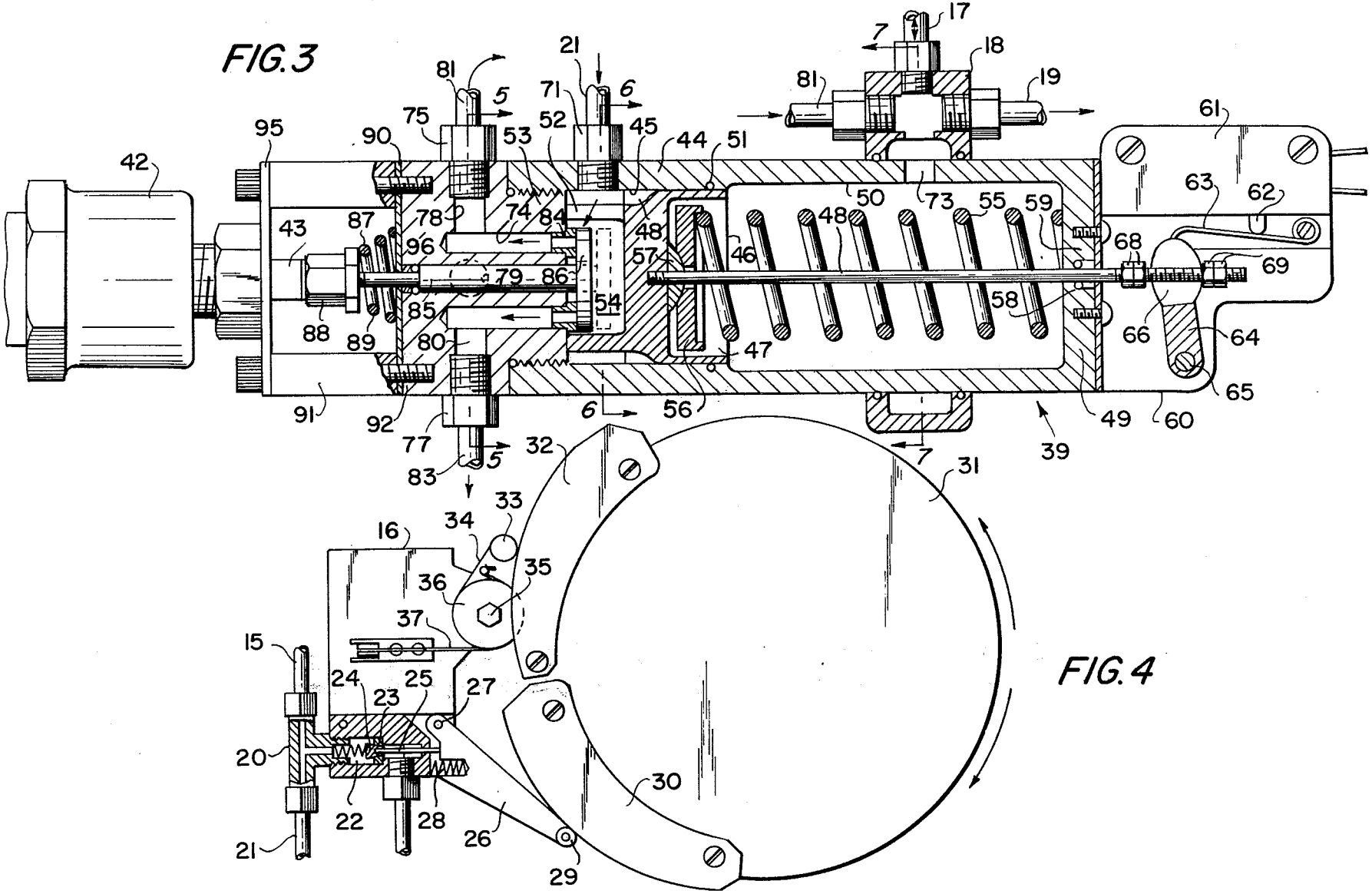
FIG. 3 is an enlarged longitudinal vertical cross-sectional view of the secondary valve assembly taken substantially on line 3—3 of FIG. 2.
FIG. 4 is an enlarged elevational view, partly in vertical cross-section, of the primary valve assembly and associated parts, as employed in the system shown in FIG. 1.

Referring now to the drawings, reference numeral 11 generally designates a monotube boiler, the water tube being designated diagrammatically at 12 and receiving its main supply of water through primary inlet 1. The water is supplied from a reservoir 13 by means of an electrically driven pump 14, the outlet conduit 15 of the pump being connected through a primary valve assembly 16 to a conduit 17 which is in turn connected to a three-way fitting 18. One of the branches of fitting 18 is connected by a conduit 19 to the inlet conduit element 1.

As shown in FIG. 4, the water supply conduit 15 is connected to one arm of a T-fitting 20, the opposite arm of the T-fitting being connected to an additional water conduit 21 for supplying secondary water to secondary valve assembly 39. The stem portion of the T-fitting 20 is connected to the conduit 17 through a primary water valve assembly included in the primary valve unit 16 and comprising an inlet chamber 22 having a wall 23 formed with an aperture in which is positioned a valve plug element 24 provided with a valve rod 25 engaged with a control lever 26 pivoted to the body of the primary valve assembly 16 at 27. Lever 26, which is biased in a counterclockwise direction, as viewed in FIG. 4, by a suitable spring 28, is provided at its free end with a follower roller 29 engaged with the edge of a control cam 30 mounted on the periphery of a rotatable boiler combustion air control disc 31 which may be coupled in a known fashion to a conventional damper mechanism such that the angular position of disc 31 establishes the mass flow of combustion air to the burner (not shown) of boiler 11. Also mounted on the periphery of the control disc 31 is a fuel control cam 32 whose cam edge is engaged by a roller 33 mounted on the free end of a fuel control lever 34 pivoted at 35 to the body of the primary valve assembly 16. Mounted on lever 34 concentrically with its pivotal axis is a guide sheave 36 around which extends a control cable 37, the end of the cable being suitably connected to lever 34. The opposite end of the cable 37 is connected to the movable element of a conventional fuel injection valve 38 mounted on the boiler 11 and controlling the injection of fuel into the combustion area of the boiler in accordance with the movement of the lever 34.

Disc member 31 thus coordinates the supply of combustion air with the supply of fuel to the boiler. The rotation of the disc member 31 may be controlled in any suitable manner, for example, by suitable manually operated means constituting the throttle input to the system.

From the above description, it will be seen that the primary supply of water to the boiler, namely, the water furnished to the conduit 17 and subsequently admitted at the main water inlet conduit element 1, is controlled in accordance with the fuel flow by the action of the lever 26, namely, in accordance with the degree of the rotation of said lever produced by cam 30 responsive to the rotation of the boiler air control disc 31. The cams 30 and 32 are designed so that as the fuel flow is increased, the primary water flow is also increased.

In accordance with the present invention, a secondary water admission control is provided for admitting secondary water into the water tube 12 at points spaced therealong where the steam in the tube is superheated, for example, at respective stations 2 and 3 illustrated diagrammatically in FIG. 1. As will be further explained, temperature-responsive means is provided at a further station 4 along the water tube 12 at a location adjacent the outlet end of the tube and downstream of station 3. The temperature responsive means controls the admission of water at stations 1, 2 and 3 during steady state operation (i.e., steam temperature at station 4 and fuel flow are constant), as well as during transient operation when the fuel flow is changing. During steady state operation over a wide range of fuel flows, the cam 30 operates to control a substantially constant percentage of water furnished to the boiler, and the temperature responsive means operates to control the balance of water such that the steam temperature upstream of station 3 (i.e., prior to injection of feedback water) is held at about 50° F. higher than the temperature at station 4.

The secondary water admission control is provided by a secondary valve assembly 39 in conjunction with a mercury-filled temperature bulb, diagrammatically shown at 40, which is mounted within the boiler adjacent the water tube at the station 4 and is suitably insulated from radiant heat and is so mounted that it is responsive to the steam temperature only. The temperature bulb 40 is connected by a suitable conduit 41 to the driving element of a conventional bellows assembly 42, or similar unit, mounted on one end of the secondary valve assembly 39 and having the movable abutment member 43, which may be arranged substantially axially with respect to the assembly 39, as illustrated in FIG. 3, and which moves rightwardly responsive to an increase of temperature sensed by the bulb 40.

Figure 8:
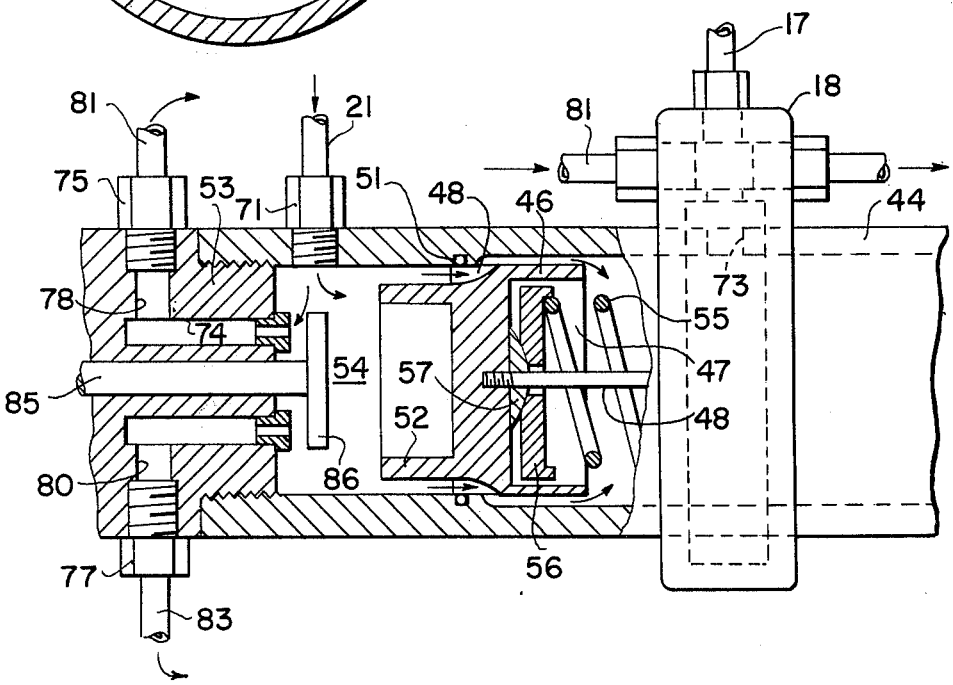
FIG. 8 is a fragmentary elevational view, partly in longitudinal vertical cross-section, of the secondary valve assembly of FIG. 3 showing the positions of the parts resulting from an excessive rise in differential pressure across the secondary valve assembly, whereby the secondary valve assembly acts as a bypass for the primary valve of the system.

The secondary valve assembly 39 comprises a generally cylindrical main housing 44 provided at its left end portion, as viewed in FIG. 3, with a cylindrical bore 45 in which is slidably and sealingly mounted a generally cup-shaped piston member 46. At its right side, as viewed in FIG. 3, the member 46 is formed with a cylindrical cavity 47 in the center of which is threadedly secured an elongated rod 48 which extends axially and rightwardly, as viewed in FIG. 3, through the right end wall 49 of a somewhat enlarged bore portion 50 forming a cavity in the cylindrical housing 44. A resilient deformable sealing ring 51 is seated in an annular groove provided in the cylindrical housing 44 leftwardly adjacent the cavity 50, as shown in FIG. 3, sealingly engaging the cylindrical rightward portion of the piston member 46. The piston member is formed with longitudinal grooves at its left portion, as viewed in FIG. 3, to define longitudinally extending vanes 48', whereby communication can be established between the enlarged chamber 50 and bore 45 when the piston 46 moves sufficiently to the right, for example, when the piston moves to the position shown in FIG. 8.

Figure 6:
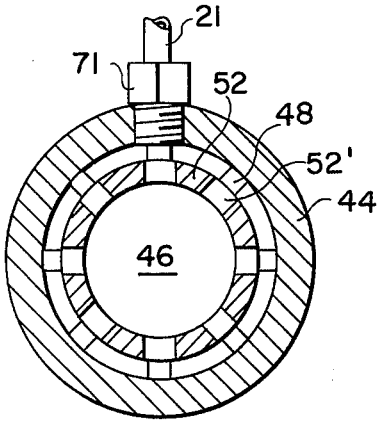
FIG. 6 is a transverse vertical cross-sectional view taken substantially on line 6—6 of FIG. 3.
Figure 7:
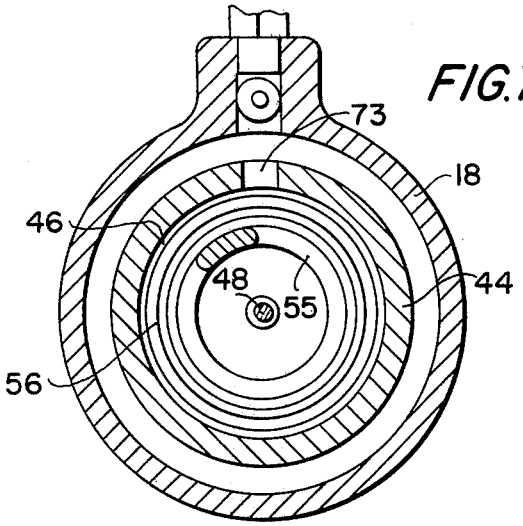
FIG. 7 is a transverse vertical cross-sectional view taken substantially on line 7—7 of FIG. 3.

Piston 46 is biased to the left as shown in FIG. 3 by a coiled spring 55 which surrounds the rod 48 and which bears between the end wall 49 and a bearing disc 56 concentrically surrounding rod 48. Disc 56 is seated on a spherically shaped washer 57 provided on rod 48, the washer being engaged against the inside transverse wall surface of the cavity 47 on piston 46. Thus, the free end of leftwardly opening cup 52 (FIG. 3) is urged by spring 55 into engagement with plug element 53 which is threaded into and seals the left-hand portion of cylindrical housing member 44. Cup 52 is smaller in diameter than piston 46 and is provided with axially extending slots 52' that interconnect the interior 54 of the cup to bore 45 (see FIG. 6).

The rod 48 extends axially through end wall 49 and is slidable therein, being sealingly engaged by resilient deformable sealing ring 58 provided in a recess 59 formed in the center portion of wall 49 and facing outwardly thereof. A bracket member 60 is secured to the outside of end wall 49 and a microswitch 61 is mounted on said bracket member, the microswitch having an operating plunger 62 and being provided with a plunger-actuating lever 63 engageable by an arm 64 pivoted to the bracket at 65, the arm having a slot 66 through which the end of rod 48 extends, the rod being provided with pairs of adjustable stop nuts 68, and 69 on opposite sides of the lever 64, as shown in FIG. 3. The electric motor which drives pump 14 is connected in an energizing circuit which includes the switch 61, and which also includes a suitable power source, such as a battery 70 (FIG. 1). In the position shown in FIG. 3, namely, with the piston 46 in its leftward limiting position, the top end of the arm 64 is in operating engagement with the lever 63, causing switch 61 to be closed, and thereby energizing the pump 14. As will be presently explained, when the pressure in the space 54 rises above a limiting amount, for example, 150 lbs. per square inch, the piston 46 moves rightwardly sufficiently to allow arm 64 to release lever 63 and allow switch 61 to open, thereby de-energizing pump 14.

As shown in FIG. 3, the conduit 21 is connected to the bore 45 of cylindrical housing 44 by a conduit fitting 71 allowing water at pump pressure to be supplied to the interior 54 of cup 52 on the left face of piston 46. The three-way connector member 18 comprises a hollow annular body which surrounds and which is sealingly mounted on the housing 44 over an aperture 73 communicating with the enlarged bore portion 50. Water at a pressure reduced by valve 16 is furnished to bore 50 by conduit 17, such pressure acting on the right face of piston 16.

Figure 5:
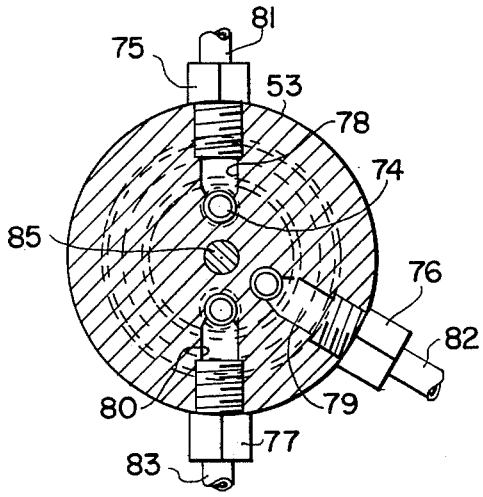
FIG. 5 is a transverse vertical cross-sectional view taken substantially on line 5—5 of FIG. 3.

The end plug member 53 is formed with three spaced longitudinally extending passages 74 (see FIG. 5) which communicate with respective conduit fittings 75, 76 and 77 through radial passages 78, 79 and 80 formed in member 53. Each of the passages 78, 79 and 80 are provided with means such as a needle valve (not shown) by which the flow rate therethrough can be selectively and individually adjusted in order to relate the flows in passages 78 and 79 to the flow in passage 80. As shown in FIG. 1, a conduit 81 connects fitting 75 to the three-way fitting 18. A conduit 82 connects conduit fitting 76 to the water inlet fitting at station 2 and a conduit 83 connects conduit fitting 77 to the inlet fitting at the water inlet station 3, which is termed the feedback station.

The longitudinally extending passages 74 are provided with end bushing elements 84 opening into the space 54, as shown in FIG. 3. The plug member 53 is formed with an axial bore in which is slidably and sealingly mounted a plunger element 85 provided at its right end, as viewed in FIG. 3, with a valve disc 86 which is operatively associated with the bushing elements 84. At its left end, as viewed in FIG. 3, the plunger 85 is provided with a reduced shank portion 87 having an abutment head member 88 adjustably engaged thereon, for example, by being threadedly engaged thereon. A biasing coiled spring 89 surrounds the shank portion 87 and bears between the head member 88 and a disc member 90 secured to the left end wall of plug element 53 by sleeve members 91, which are threadedly engaged on studs 92 secured in member 53 in the manner illustrated in FIG. 3. The bellows assembly 42 is mounted on a supporting disc member 95, which is in turn secured to the left ends of the sleeve members 91 by screws 95'.

The plunger 85, which is sealed by ring 96 surrounding shank portion 87, is thus biased leftwardly by the action of the spring 89 toward a position at which the valve disc element 86 would sealingly cover the bushing members 84 and close off the passages 74 with respect to the space 54. Under steady state conditions, as defined above, station 4 will be at the set-point temperature and bulb 40 will be effective to overcome the bias of spring 87 and hold disc 86 at an axial position at which space 54 communicates with bores 74 thus allowing water in the space (which is at pump pressure) to enter bores 74 for delivery to stations 1, 2, and 3. The water flow through the boiler will thus depend on the contour of cam 30 since this establishes the primary water controlled by valve 16 and flowing through conduit 17, and on the temperature at station 4 since this establishes the opening of disc 86 relative to seat 84, and hence the secondary water flowing through conduits 81, 82, and 83. Close control is exerted by reason of arranging for the secondary water injected at stations 1 and 2 to be proportional to the feedback water injected at station 3.

In accordance with the adjustment of the head member 88 on the shank 87 and the tension in the spring 89, the valve disc 86 will be moved rightwardly from the closed position thereof shown in FIG. 3 to unseal the bushing elements 84 when a predetermined temperature is sensed by the temperature-sensing bulb element 40.

In operation, fuel and air are supplied to the burner (not shown) associated with the fuel injection device 38 in boiler 11, the fuel being ignited by suitable conventional ignition means in the boiler 11, the fuel and air being proportioned suitably by the action of the cam 32. When the pressure differential across piston 46 is below a specific amount, for example, 150 lbs. per square inch, the piston member 46 will be in the position thereof shown in FIG. 3 and the switch 61 will be closed, causing the pump 14 to be energized and to furnish water to conduit 17 through the primary water valve assembly 16 in accordance with the position of the control cam 30. As above-mentioned, this constitutes the main supply of water to the water tube element 12, this main supply flowing through the three-way fitting 18 and the conduit 19 to the water inlet conduit 1.

As above-mentioned, additional water is furnished through the conduit 21 and slot 52' (FIG. 6) in cup 52 of piston 46 to the space 54, and this additional supply of water is delivered to the stations 1, 2, and 3 in the manner above-described responsive to the action of the sensing bulb 40. When the sensed temperature at station 4 differs from the set-point, the plunger member 85 moves axially by the action of abutment member 43, changing the position of disc 86 relative to the bushings 84 and such that a change occurs in the flow of water from space 54 through the passages 74, 78, 79 and 80, thereby changing the flows through the conduits 81, 82 and 83 respectively to the stations 1, 2 and 3. In this manner, the set-point temperature is maintained substantially constant even during rapid changes in fuel rates when a transient condition exists in the boiler.

As previously mentioned, the water injected by the action of the valve assembly comprising plate member 86 and bushing elements 84 provides a proportional amount of additional water at stations 1, 2 and 3 simultaneously, the supplemental water flow rate at each station 1, 2 and 3 being approximately 5% of the total volume of water supplied to the water tube member 12. This proportional value is necessary in order to prevent over-controlling and hunting of temperatures.

The supplemental water injected at the station 3 acts as a feedback response for the temperature bulb 40 at the station 4. As the temperature at the station 4 increases above its set-point, the temperature bulb 40 causes the disc 86 to move further from bushing elements 84 and allows more secondary water to be furnished at the stations 1, 2 and 3. The increase in secondary water injected at the station 3 almost immediately reduces the temperature sensed at the station 4 with the result that disc 86 is soon moved toward bushing 84. Thus, the reaction to an increase in temperature is quickly fed back in a way that reduces the temperature.

It has been found that the above-described secondary control system can hold the temperature at the station 4 to within about 5° F. of a specific rated value. In a typical design, the temperature upsteam of the station 3 will be held at approximately 50° higher than at the station 4 by reason of the quantity of water injected at station 3. This temperature difference is necessary to insure the injection of water at the station 3 at all times in order for temperature bulb 40 to maintain the rated output temperature. Supplemental water will be injected at the station 3 as long as the temperature at the station 4 does not drop below a preselected or setpoint value. The action of the feedback system thus defined is such as to hold the temperature sensed by the bulb 40 at the station 4 substantially constant at the set-point.

Supplemental water injected at the stations 1 and 2 at a rate proportional to the rate at which water is injected to the station 3 serves two purposes: it prevents the temperature at the station 3 from deviating by more than a relatively small amount from its normal value of 50° F. above the temperature at the station 4; and it prevents the tube upstream of station 3 from becoming overheated during transient operations in which a large amount of heat is suddenly furnished to the boiler.

The location of the temperature sensing bulb 40 and the water feedback station 3 are at specific lengths from the steam exit conduit 97 such that the temperature of the steam supplied by the conduit 97 to a utilization device is as high as that of the steam at station 4. If the temperature bulb 40 and the station 3 were located at the steam exit conduit 97, the steam in the boiler, and consequently the boiler tube temperature, would be approximately 50° F. higher than that of the steam flowing through the outlet conduit 97, because of the temperature drop produced by the water normalizer (not shown) forming part of the system.

As above-mentioned, the water pump 14 is energized when there is less than a predetermined pressure differential, for example, 150 lbs. per square inch, between the water in the conduits 21 and 17, namely, the pressure differential across the piston 46, determined by the force of the coiled spring 55. As this pressure differential increases, the spring 55 yields and allows piston 46 to move rightwardly from the position thereof shown in FIG. 3, whereby rod 48 rotates arm 64 in a clockwise direction, as viewed in FIG. 3, allowing arm 63 to move downwardly sufficiently to release plunger element 62 and cause switch 61 to open, thereby de-energizing the pump 14. A reverse action takes place when the pressure differential across piston 46 diminishes to its limiting value, for example, 120 lbs. per square inch. When switch 61 is again closed, the pump 14 becomes energized to again supply water to boiler tube 12.

In the event of a malfunction whereby pump 14 does not become de-energized in response to the above-described rise in the pressure differential across piston 46, the piston is moved rightwardly from the position thereof shown in FIG. 3 sufficiently so that the portion of the piston having the vanes 48 moves past the sealing ring 51 to thereby allow water to flow from space 54 into the enlarged bore portion 50 and thence through passage 73 and conduit 19 to the main inlet station 1, thereby bypassing the primary valve assembly 16 and preventing an excessive pressure build up.

In a system such as that above described, a definite minimum pressure drop is required, for example, 150 lbs. per square inch, across conduits 21 and 17, namely, between the outlet of pump 14 and the main water inlet station 1, to insure fairly proportional water flow rates for all three water injection points regardless of the pressure drop through the boiler as long as said pressure drop is less than 150 lbs. per square inch. For example, assume that the pressure at station 1 is 150 lbs. per square inch higher than the pressure at station 3. The pressure drop across the secondary valve outlet passage for station 3, namely, between conduit 83 and conduit 21 will be approximately 300 lbs. per square inch. Although this pressure drop is approximately twice that of the pressure drop at station 1 with respect to conduit 21, the water flow at station 3 is only approximately 25% higher than that at station 1, which is still sufficiently proportional to prevent over-controlling. As above-mentioned, the same 150 lbs. per square inch pressure differential is likewise maintained across the primary water valve assembly 16.

From the above description, it will be seen that the primary supply of feed water changes with changing fuel flow, since said primary feed water supply is controlled by the cam 30 which is positively coupled with the fuel flow-control cam 32. Thus, the primary feed water supply is adjusted to meet the boiler water needs in accordance with changing fuel flow rates. Superimposed on this primary control is the secondary water control which is governed completely by temperature conditions in the boiler and which injects secondary water in proportional amounts at three spaced points along the boiler water tube. One of the injection points, namely, the station 3, is just ahead of the temperatures-ensing bulb 40 associated with the secondary water control. This water injection acts as a feedback agency associated with the temperature-sensing bulb 40, so that the temperature pick-up device 40 responds immediately to the water injected. This control arrangement can therefore hold the temperature in the boiler, as represented by that at the sensing bulb 40 very accurately within a narrow desired range.

It will be further noted that the injection of water at spaced points along the boiler tube 12 rather than at one point in the tube not only controls the temperature adjacent the sensing bulb 40 but also controls the temperatures in the boiler ahead of the sensing bulb. For example, if water were only injected at station 3, for example, in response to a sensed temperature of the order of 700° F., the temperature ahead of station 3 could be excessively high, for example, of the order of 1200° F. Therefore, unless water is injected upstream from station 3, for example, at stations 1 and 2, at proportional amounts with respect to that injected at the station 3, there would be nothing to control the boiler temperatures ahead of the feedback water provided at station 3. Without the additional proportional upstream-spaced additional water injection, the upstream temperatures could be of such excessive values as to damage the boiler tube assembly during changes in fuel rates, even with the primary water flow rate adjustment provided by cam 30 and primary valve assembly 16.

Thus, the above-described system provides primary control which anticipates the boiler's need for additional water before the boiler temperature changes due to a change in fuel rate, and then provides accurate secondary water control which is responsive entirely to the temperature conditions in the boiler tube. In the specific embodiment described above, the secondary water control valve assembly 39 injects a proportional amount of supplemental water at three different points along the boiler tube, one of the injection points being just ahead of the temperature pick-up device 40. This supplementary water injection acts as a feedback agency responding to the temperature pick-up device 40 and produces an immediate response on the pick-up device 40 to the supplementary injected water.

Figure 9:
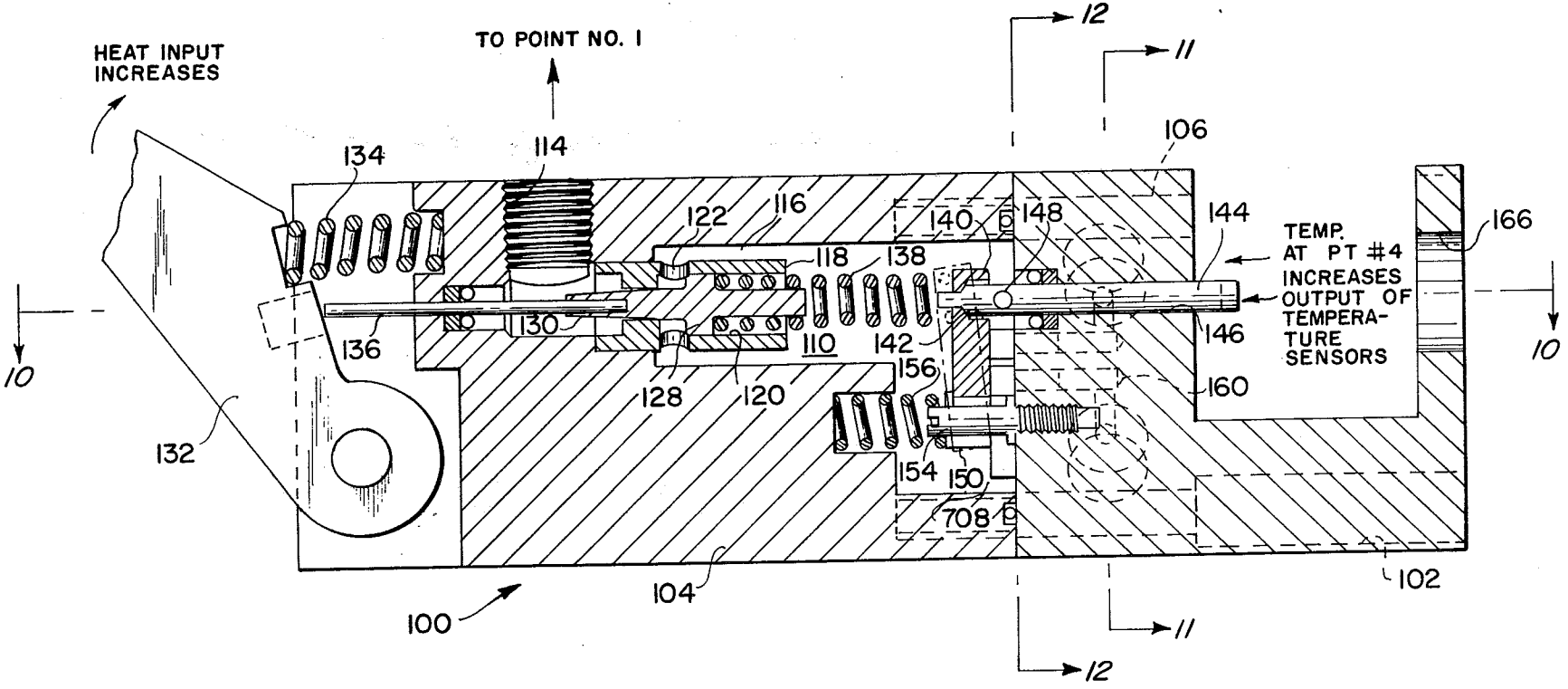
FIG. 9 is a sectional view of a combined primary and secondary valve that may replace the separate valves shown in FIG. 1.
Figure 10:
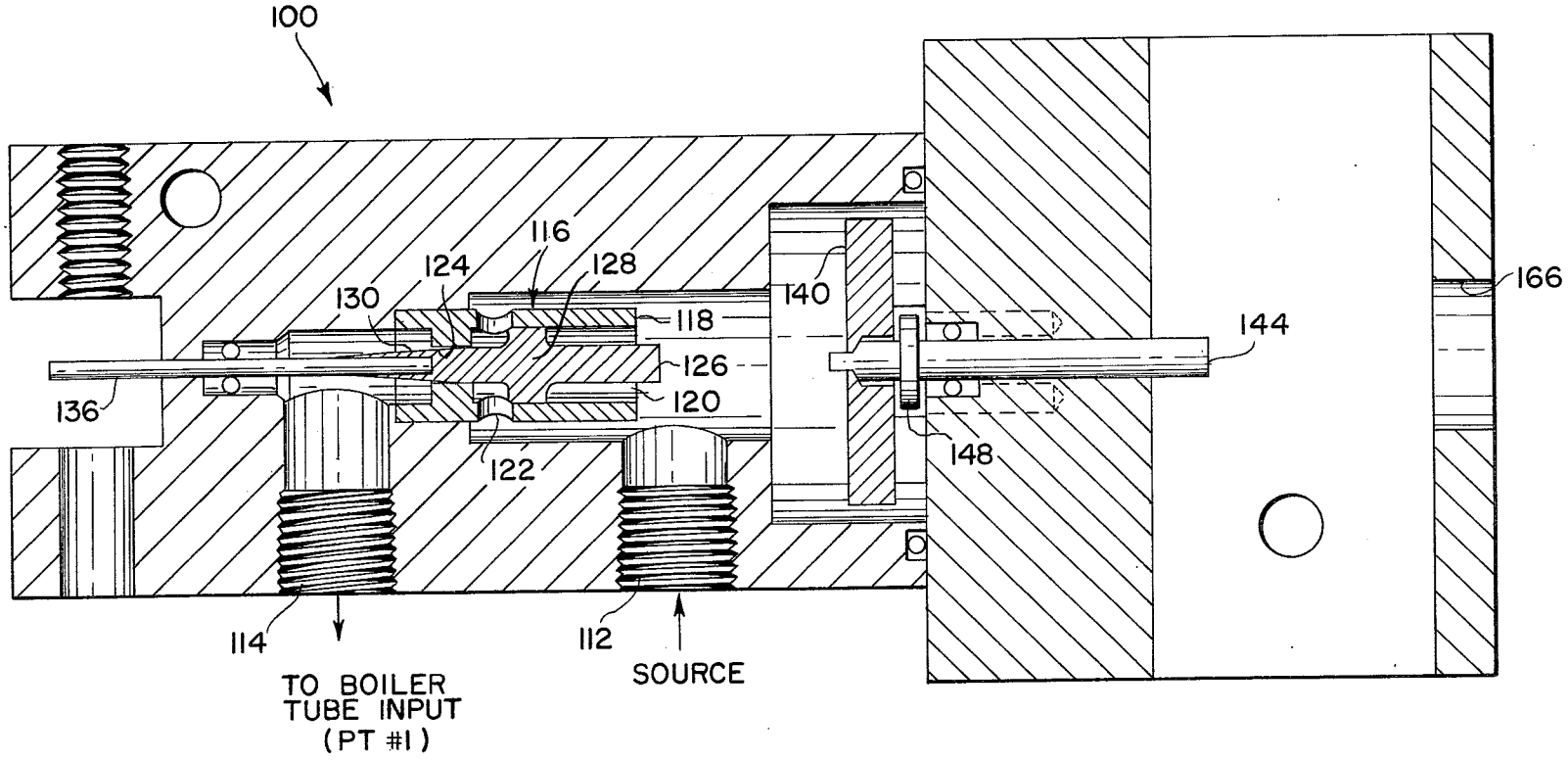
FIG. 10 is a sectional view of the combined valve taken along the line 10—10 of FIG. 9.

The separate primary and secondary water valves 16 and 39 shown in FIG. 1 may be replaced by a combined primary and secondary valve designated by reference numeral 100 in FIGS. 9 – 12. As shown in FIGS. 9 and 10, valve 100 comprises a mounting block 102 by which the valve can be secured to a fixed surface, and housing 104 connected to the mounting block by bolts indicated by reference numberal 106. Housing 104 is counterbored at the end facing the mounting block providing an enlarged chamber 108 connected to an axially extending chamber 110. Transverse inlet 112 in the housing is connected to the outlet side of pump 14 so that chambers 108 and 110 contain water at the pump pressure. Transverse outlet 114 in the housing spaced from inlet 112 is connected to chamber 110 by a primary valve means 116, outlet 114 being connected to the boiler tube inlet at point 1 by a conduit (not shown).

The valve means 116 comprises a cylindrical body 118 coaxially mounted in chamber 110 and provided with a counterbore 120 and a plurality of transverse holes 122 connected to bore 120. Valve 116 has a central web containing a metering orifice 124 interconnecting bore 120 with outlet 114. Needle valve 126 is coaxially mounted within cylindrical body 118 and slides axially by reason of the sliding engagement between collar 128 and the counterbore in body 118. The needle valve carries a tapered forward section 130 projecting into cylindrical meter orifice 124 such that the axial position of the needle valve establishes the effective area of the orifice and thus controls the amount of primary water furnished by the pump to the boiler tube inlet.

The axial position of the needle valve is controlled by the angular position of cam follower 26A (FIG. 9), which is pivotally mounted on the free end of housing 104 and is held in engagement with water-cam 30 (see FIG. 1) by the action of spring 134 biasing the follower away from engagement with rod 136 which is rigidly attached to needle valve 126.

Needle valve 126 is biased, in a direction tending to restrict orifice 124, by the action of spring 138 interposed between collar 128 on the needle valve and valve plate 140 of secondary valve means 141. Plate 140 is located in chamber 108 adjacent mounting block 102, and is provided with a counterbored aperture 142 that receives actuating rod 144 slidably mounted in coaxial bore 146 in block 102. Axial displacement of rod 144 to the left as seen in FIG. 9 imparts movement to plate 140 by reason of transverse pin 148 rigidly connected to the rod. Spring 138 resists this movement of the rod.

Figure 11:
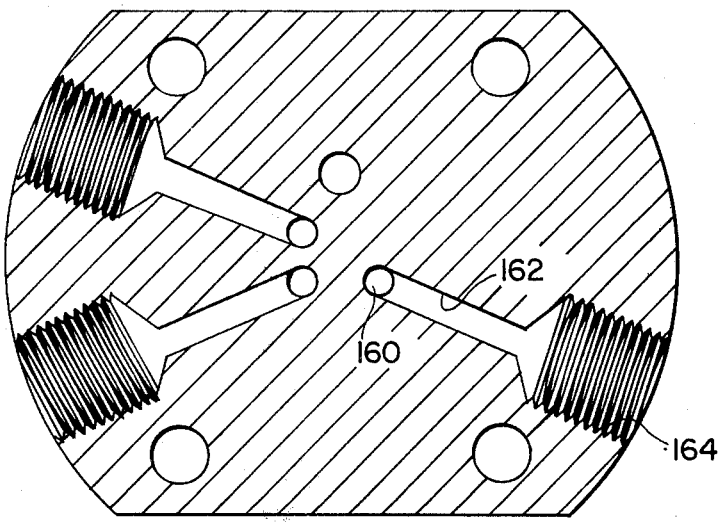
FIGS. 11 and 12 are sectional views of the combined valve taken along the lines 11—11 and 12—12, respectively, of FIG. 9.
Figure 12:
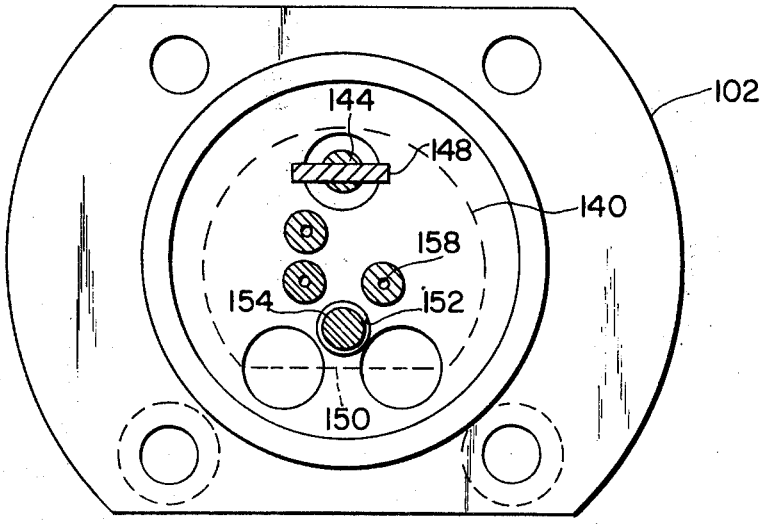

Plate 140 is substantially round as shown in FIG. 11 but is provided with a flat edge 150 remote from aperture 142 and contains aperture 152 adjacent edge 150 for receiving a guide bolt 154 extending from and attached to mounting block 102. Spring 156 (FIG. 9) is engaged with the valve plate and cooperates with spring 138 for urging the valve plate into sealing relationship with the plurality of valve seats 158 mounted on the block 102 and extending into chamber 108. Each of the valve seats is in the form of a bushing similar to that shown by reference numeral 84 in FIG. 3, which bushing is fixed in an axially extending blind bore 160 in block 102 as shown in FIG. 9. Each of these blind bores is connected by a transverse conduit 162 (FIG. 11) to a threaded hole 164 respectively associated with conduits (not shown) leading to the various input points along the boiler tube.

Actuating rod 144, which corresponds to shaft 85 shown in FIG. 3, is acted on by the output of the temperature sensor at point 4 in the boiler tube. That is to say, the temperature bellows assembly 42 (FIG. 3) is mounted in the coaxial hole 166 in the mounting block so that the axial position of the actuating rod 144 will be determined by the temperature at point 4 in the boiler tube. When the temperature at point 4 increases, rod 144 is moved to the left as seen in FIG. 9, causing plate 140 to pivot as indicated by the phantom lines, thereby differentially uncovering the valve seats 158. Upon pivoting of this plate, secondary water is metered through the valve seats and is provided to the various input points along the boiler tube.

By reason of the construction described above, primary water is furnished to the inlet to the boiler in accordance with the amount of heat furnished to the boiler, and secondary water is furnished to the input point along the length of the boiler tube in accordance with the sensed temperature of the steam. The pivoting nature of plate 140 with respect to the valve seats 158 causes the secondary water supplied to the various input points along the length of the boiler tube to be proportional to the water supplied to the feedback point 3.

It is believed that the advantages and improved results furnished by the temperature control apparatus of the present invention will be apparent from the foregoing description of the preferred embodiments of the invention. Various changes and modifications may be made without departing from the spirit and scope of the invention as sought to be defined in the following claims.

We claim:

1. Temperature control apparatus for a monotube steam-generating boiler having a tube with an inlet end for receiving primary water and an outlet end for providing superheated steam to a utilization device, and having heating means for providing heat to the boiler tube, said apparatus comprising:

a. heat control means for variably controlling the amount of heat provided by the heating means;

b. temperature sensing means for sensing the temperature of the steam generated in the boiler tube at a location adjacent the outlet end where the steam is superheated;

c. a plurality of input points located in the boiler tube upstream of the location of the temperature sensing means, one input point being adjacent to the temperature sensing means providing a feedback point;

d. primary water supply means responsive to the heat control means for supplying primary water to the inlet end of the boiler tube in accordance with the amount of heat provided by the heating means; and e. secondary water supply means responsive to the temperature sensing means for supplying secondary water to each of the input points in accordance with the sensed temperature of the steam and for causing the water supplied to each input point other than the feedback point to be proportional to the water supplied to the feedback input point.

2. Apparatus according to claim 1, wherein the rate at which water is supplied to the feedback input point exceeds the rate at which water is supplied to the other input point.

3. Apparatus according to claim 1, wherein the inlet end of the boiler tube is an input point.

4. Apparatus according to claim 1, wherein the amount of secondary water supplied to a downstream input point is greater than the amount of secondary water supplied to an upstream input point.

5. Apparatus according to claim 1, wherein the temperature sensing means comprises a mercury-filled bulb.

6. Apparatus according to claim 1, wherein the amount of secondary water under steady state conditions comprises approximately 15 percent of the total amount of primary water.

7. Apparatus according to claim 1, including a source of water under pressure, and said primary water supply means includes primary valve means connected between said source and the inlet end of the boiler tube, the primary valve means being responsive to the heat control means for varying the amount of primary water in accordance with variations in the amount of heat provided by the heating means, and said secondary water supply means includes secondary valve means connected between said source and the input points, the secondary valve means being responsive to the temperature sensing means for varying the amount of secondary water in accordance with variations in the sensed temperature.

8. Apparatus according to claim 7, including means for by-passing the primary valve means and directly connecting the source to the inlet end of the boiler tube when the pressure drop across the primary valve means exceeds a predetermined threshhold.

9. Apparatus according to claim 8, wherein the source of water under pressure comprises a water pump, and wherein pump control means are provided for operating the pump to maintain the pressure drop across the primary valve means substantially at a predetermined value.

10. Apparatus according to claim 9, wherein the primary valve means has an inlet passage connected to said source and an outlet passage connected to the inlet end of the tube, and wherein the pump control means comprises a chamber having a piston longitudinally movable therein, first conduit means connecting the chamber of the piston on one side to the outlet passage of the primary valve means, second conduit means connecting the chamber of the piston on the other side to said source, means for biasing the piston toward the end of the chamber at the higher pressure so that the axial position of the piston in the chamber is determined by the pressure drop across the primary valve means, and pump-actuating means responsive to the position of the piston for energizing the water pump when the pressure drop across the valve means is less than said predetermined value and for de-energizing the water pump when the pressure drop is equal to or greater than said predetermined value.

11. Apparatus according to claim 10, wherein the water pump is electically powered, and wherein the pump-actuating means comprises a source of electrical potential and switch means responsive to the axial position for selectively connecting and disconnecting the pump from the source of potential.

12. Apparatus according to claim 11, wherein the piston and the wall of the chamber have cooperable configurations for connecting the first and second conduits through the chamber when the pressure drop across the valve means reaches a predetermined threshhold.

13. Apparatus according to claim 7, wherein:

the valve means comprises a primary valve for connection between the source of water and the inlet end of the boiler tube, the primary valve being responsive to the heat control means for varying the amount of primary water in accordance with the heat provided by the heating means, and the secondary valve means has first and second cavities interconnected by a movable valve member whose position establishes the quantity of water transferred from the first to the second cavities, an inlet passage for connecting the first cavity to said source of water, and a plurality of outlet passages connecting the second cavity to the respective input points of the boiler tube, the outlet passages communicating with the second valve cavity through respective orifices, and valve member control means responsive to the temperature sensing means for positioning the valve member in accordance with the sensed temperature.

14. Apparatus according to claim 13 wherein the orifices lie in the same plane, and wherein the valve member is movable in a direction substantially perpendicular to the plane to provide substantially proportional flows in the different outlet passages.

15. Apparatus according to claim 13, wherein the orifices lie in the same plane, and wherein the valve member is supported for pivotal movement relative to said plane to provide unequal flows of secondary water through the outlet passages.

16. Apparatus according to claim 13, wherein said heat control means comprises a rotatable cam plate and means engageable with a first camming surface on the cam plate for controlling the amount of heat produced by the heating means, and wherein the primary valve means has means engageable with a second camming surface on the cam plate for adjusting the flow of primary water in accordance with the amount of heat produced by the heating means.

* * * * *